United States Patent [19]

Capra et al.

[11] 4,235,353

[45] Nov. 25, 1980

[54] TRIGGER OPERATED DISPENSING DEVICE WITH ACCUMULATING CHAMBER

[75] Inventors: Nicholas G. Capra, East Hanover, N.J.; Ronald L. Antenore, Coral Gables, Fla.

[73] Assignee: James D. Pauls and J. Claybrook Lewis and Associates, Limited, Miami Lakes, Fla.

[21] Appl. No.: 889,904

[22] Filed: Mar. 24, 1978

Related U.S. Application Data

[62] Division of Ser. No. 729,830, Oct. 5, 1976, Pat. No. 4,167,964.

[51] Int. Cl.[2] ..... B05B 11/02

[52] U.S. Cl. ..... 222/256; 222/321; 222/341; 222/383

[58] Field of Search ..... 222/256, 257, 321, 335, 222/340, 341, 380, 382, 383, 384, 385; 239/321, 322, 333; 417/328, 544

[56] References Cited

U.S. PATENT DOCUMENTS

| | | | |
|---|---|---|---|
| 2,545,319 | 3/1951 | Sundholm | 222/256 |
| 3,685,739 | 8/1972 | Vanier | 222/383 X |
| 3,777,945 | 12/1973 | Nozawa et al. | 222/335 X |
| 3,921,861 | 11/1975 | Kondo | 222/257 |
| 3,927,834 | 12/1975 | Tada | 222/383 X |
| 3,940,029 | 2/1976 | Horvath | 239/333 X |
| 4,033,487 | 7/1977 | Micallef | 239/526 X |

FOREIGN PATENT DOCUMENTS

| | | | |
|---|---|---|---|
| 1272279 | 4/1972 | United Kingdom | 222/383 |
| 1464176 | 2/1977 | United Kingdom | 222/383 |

*Primary Examiner*—Stanley H. Tollberg
*Assistant Examiner*—Fred A. Silverberg
*Attorney, Agent, or Firm*—Dennis H. Lambert

[57] ABSTRACT

A dispensing device for discharging material under pressure, includes at least one accumulating chamber for receiving and accumulating material to be dispensed and operable to discharge the material under pressure over a sustained period of time for use as desired, and at least one expansible chamber operable to incrementally move material from a container into the accumulating chamber for storage of the material under pressure, whereby a prolonged, pressurized discharge of the material can be obtained.

3 Claims, 2 Drawing Figures

TRIGGER OPERATED DISPENSING DEVICE WITH ACCUMULATING CHAMBER

BACKGROUND OF THE INVENTION

This application is a Division of application Ser. No. 729,830, filed Oct. 5, 1976, now Pat. No. 4,167,941 and entitled Mechanically Operated Dispensing Device With Means For Increasing Discharge Pressure And Dispensing Time.

This invention relates to a mechanically operated dispensing device for discharging materials under pressure, and in a preferred form, relates to such devices for effecting a spray of the material.

In the prior art, many different types of dispensing devices are provided, and include aerosol spray discharge devices operated by chemical propellants and pump operated spray discharge devices. Both of these prior art types of dispensers create a hazard to the environment and recent legislation has indicated that such propellant operated devices may be prohibited in a few years due to the potential harm to the environment caused by the propellants used in such devices to effect discharge of the material. Additionally, propellant operated devices must be specially constructed in order for the containers to withstand internal pressures, and a danger to children is created due to the likelihood of a small child operating the device and effecting discharge of a potentially harmful material into the face or eyes of the child. Chemical propellant operated dispensing devices further are limited in their use due to chemical incompatibility between the propellant and the material to be discharged.

Pump type dispensing devices, while not possessing the disadvantages that chemical propellant operated dispensing devices have, nonetheless are unsatisfactory for several reasons, including the fact that they are difficult and inaccurate to use, since the pressure generated for dispensing the material is effected by operating a plunger or trigger mechanism with the finger of the user. Further, pump type devices produce only a limited spray time, since each discharge of the material is accomplished with each operation of the plunger or trigger and the like, and thus repeated operation of the pump devices is sometimes necessary in order to effect discharge of a desired amount of material. Pump devices also present a danger to small children, since they may be inadvertently operated by a child, thereby effecting discharge of a potentially harmful substance.

The present invention solves the above problems of the prior art devices, and provides a simple and rugged structure which is capable of producing a relatively long and high pressure spray with only a single operation of a spray nozzle or actuator. Moreover, very little input pressure or torque is required in order to produce a much greater discharge pressure of the material, and in fact, the pressure of the material discharged may be regulated with some forms of the invention.

Still further, the structure of the present invention is such that danger to small children and the like is reduced because of the fact that dual manipulations are required in order to effect discharge of the material, and unique leak back provisions are made, whereby the pressurized contents of the discharge device are slowing permitted to leak back into the container, thus unloading the discharge reservoir, whereby subsequent actuation of the discharge nozzle or spray by an unsuspecting person will not effect an unexpected discharge of the material.

OBJECTS OF THE INVENTION

An object of the invention is to provide a mechanically operated dispensing device, wherein a relatively low input force effects a relatively high discharge pressure of material.

Another object of the invention is to provide a mechanically operated dispensing device, wherein a prolonged dispensing time is obtained with a single operation of a discharge nozzle or valve, whereby repeated operations of the discharge nozzle or valve are not necessary to effect discharge of a desired amount of material.

A further object of the invention is to provide a mechanically operated dispensing device, wherein accumulating means is provided for accumulating in increments an amount of material to be discharged under pressure, and wherein means is operable to effect continous and selective discharge of the material from the accumulating means over a desired period of time with a substantially constant discharge pressure.

An even further object of the invention is to provide a mechanically operated dispensing device wherein first expansible chamber means are operable to pressurize and incrementally introduce a material to be dispensed into an accumulating chamber for accumulation of the material under pressure, and means operable to effect release of the accumulated pressurized material from the accumulating chamber, whereby a prolonged pressurized discharge of the material is obtained, with only a single operation of a spray nozzle or release valve.

Still another object of the invention is to provide a mechanically operated dispensing device including accumulating means for obtaining a substantially continuous prolonged pressurized discharge of material, and wherein the dispensing device may be readily attached to existing threaded bottles or containers and the like.

Another object of the invention is to provide a mechanically operated dispensing device which is relatively simple and economical to make and which may be readily molded in a minimum number of parts and assembled at a minimum cost.

Yet another object of the invention is to provide a mechanically operated dispensing device which includes a manually operable member accessible exteriorly of the device, said manually operable member being connected with first expansible chamber means to operate the expansible chamber means to incrementally charge an amount of material into an accumulating chamber for discharge of an accumulated amount of material over a prolonged period of time in a substantially continuous constant pressure spray, and wherein the manually operable means is stationary during discharge of material from the accumulating chamber.

A further object of the invention is to provide an aerosol dispenser for obtaining prolonged discharge of the material, wherein the aerosol dispenser is trigger operated and is thus capable of use with one hand for charging the accumulating chamber and effecting discharge of the material.

DETAILED DESCRIPTION OF THE INVENTION

Figure 1:
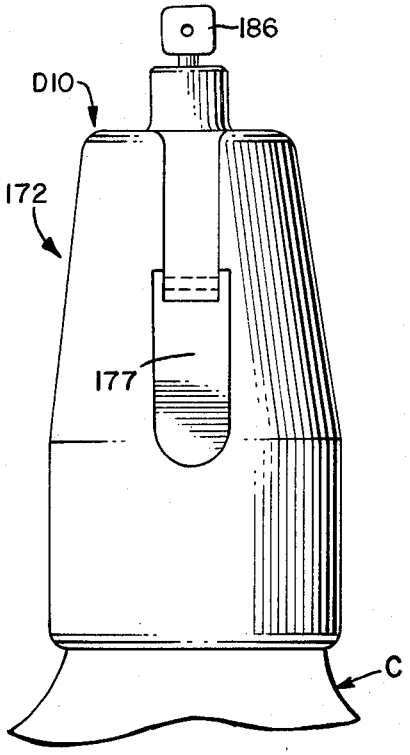
FIG. 1 is a front view in elevation of the trigger operated device of the invention.
Figure 2:
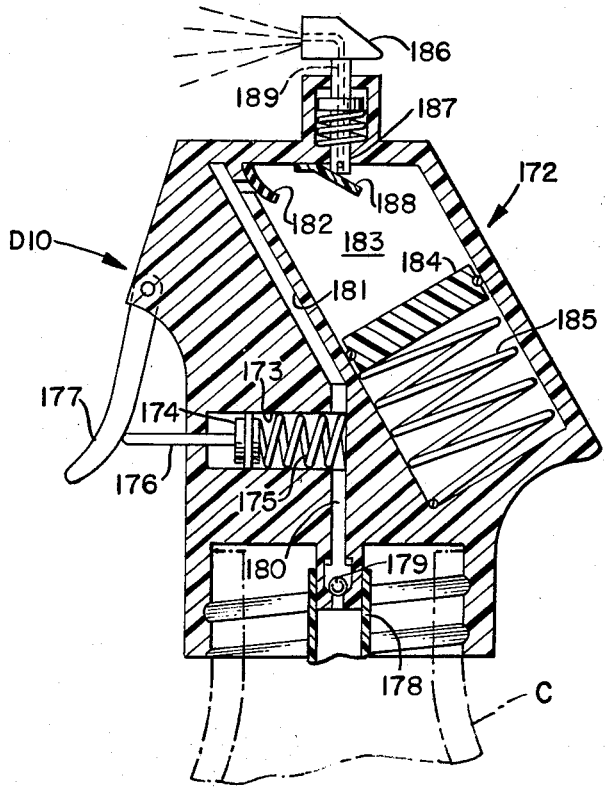
FIG. 2 is a vertical, longitudinal view in section of the device of FIG. 1.

Referring now more specifically to the drawings, wherein like reference numerals indicate like parts throughout the several views, the dispensing device according to the invention is indicated generally at D10, and is a trigger operated mechanism 172 including a body having a first expansible chamber means comprisng a first piston chamber 173 in which a first movable member or piston 174 is reciprocably mounted. The piston is urged outwardly by a spring 175 and a stem or pin 176 projects outwardly of the chamber 173 for cooperation with a trigger 177, whereby movement of the trigger 177 reciprocates the piston 174 in a direction to reduce the size of chamber 173. Release of the trigger enables the spring 175 to urge the piston 174 to the left, as viewed in FIG. 2, thereby drawing material upwardly through a tube 178 from a container C past a valve 179 and through a passage 180 into the piston chamber 173. Rearward movement of the trigger pressurizes the material in chamber 173, forcing it upwardly through a passage 181 and past a flap valve 182 into a second expansible chamber means, comprising a second, accumulating chamber 183, thereby urging a piston 184 in the accumulating chamber downwardly against the bias of a spring 185.

When it is desired to discharge the material from accumulating chamber 183, a discharge means or nozzle 186 is depressed, moving a stem 187 downwardly to open a discharge valve means or flap valve 188 and establishing communication between the accumulating chamber 183 and a passage 189 in the stem.

Additionally, and if desired, a fill opening may be provided anywhere on the container for refilling it with material when the contents have been exhausted. One specific example of a suitable fill opening and removable closure therefor is shown at 69, 70, and 72 in FIG. 7 of co-pending Application Ser. No. 724,006, now U.S. Pat. No. 4,105,145 filed Sept. 16, 1976. Of course, the fill opening could be in the side, top or bottom of the container as desired.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by whose claims.

We claim:

1. A dispensing device for discharging material under pressure, includes accumulating chamber means for receiving and acumulating material to be dispensed, normally closed discharge valve means connected with the accumulating chamber means and operable to an open position to discharge the material from the accumulating chamber means under pressure over a sustained period of time for use as desired, said discharge valve means including a movable member operable to open and close the valve means and having a passage therethrough communicating the accumulating chamber means with atmosphere when open, expansible chamber means connected with the accumulating chamber means and operable to repeatedly introduce material from a container into the accumulating chamber means for storage under pressure of a quantity of the material greater than the volumetric capacity of the expansible chamber means, whereby a prolonged, pressurized discharge of the accumulated material can be obtained from the accumulating chamber means when the discharge valve means is opend and a manually operable pivoted trigger pivotally secured one end thereof to the dispensing device and connected with the expansible chamber means to operate the expansible means to alternately draw material into the expansible chamber means and then pressurize the material and discharge it into the accumulating chamber means, said pivoted trigger enabling the dispensing device to be operated with one hand while being held in that hand, by simply squeezing the trigger means to charge material into the accumulating chamber means, and then operating the discharge valve means to discharge the material therefrom.

2. A mechanically operated dispensing device, comprising:

a body having fastening means on one end thereof for attachment of the body to a container of material to be dispensed;

said body having a first bore therein between the ends thereof and a second bore adjacent the first bore and being at an acute angle and out of alignment with the first bore and being larger in diameter than the first bore;

said body also having a passageway opening through said one end thereof for communication with the contents of a container secured to the body, said passageway communicating with one end of each of said first and second bores;

first valve means in the passageway enabling flow from a container into the passageway but preventing reverse flow;

second valve means in the passageway enabling flow from the passageway into the second bore but preventing reverse flow;

a first piston reciprocable in the second bore defining a pumping chamber therewith;

a second piston reciprocable in the second bore defining an accumulating chamber therewith, and larger in diameter than the first piston;

said body having a discharge passage extending from the second bore to outside the body;

discharge valve means normally closing the discharge passage and maintained in closed position by pressure within the second bore;

a discharge nozzle carried by the top of the body and having a stem extending through the discharge passage into proximity with the discharge valve means for opening the discharge valve means when the discharge nozzle is depressed;

biasing means normally urging the first piston in a direction to enlarge the pumping chamber;

biasing means normally urging the second piston in a direction to reduce the accumulating chamber volume; and a trigger pivotally connected at one end thereof to the side of the body and being connected with the first piston to reciprocate the first piston in a direction to reduce the volume of the pumping chamber, whereby material therein is pressurized and caused to flow into the passageway and then into the accumulating chamber urging the second piston in a direction opposed to the biasing means to store a quantity of material under pressure for subsequent prolonged discharge.

3. A dispensing device as in claim 2, wherein the fastening means comprises a threaded member for threaded cooperation with like threads on the container.

* * * * *